US005626415A

United States Patent [19]

Huang

[11] Patent Number: 5,626,415

[45] Date of Patent: May 6, 1997

[54] MOISTUREPROOF DECORATIVE BULB FOR CHRISTMAS DECORATIONS

[76] Inventor: Shun-Feng Huang, No. 13, Lane 84, Nei Hu Road, Nei Nu Sub-Ward Hsin-Chu, Taiwan

[21] Appl. No.: 491,294

[22] Filed: Jun. 12, 1995

[51] Int. Cl.[6] ..... F21V 31/00

[52] U.S. Cl. ..... 362/226; 362/267; 362/363; 362/391; 439/619; 439/699.2

[58] Field of Search ..... 362/226, 391, 362/363, 267; 439/699.2, 619, 345, 370–372

[56] References Cited

U.S. PATENT DOCUMENTS

| | | | |
|---|---|---|---|
| 4,943,899 | 7/1990 | Tseng | 362/226 |
| 5,001,615 | 3/1991 | Stefanelli | 362/226 |
| 5,021,706 | 6/1991 | Chen | 362/226 |
| 5,184,890 | 2/1993 | Chen et al. | 362/226 |
| 5,361,192 | 11/1994 | Lai | 362/226 |
| 5,499,174 | 3/1996 | Lin | 362/363 |

*Primary Examiner*—Ira S. Lazarus
*Assistant Examiner*—Sara Sachie Raab

[57] ABSTRACT

A decorative bulb contains a bulb casing, a bulblet, a bulblet socket, a casing socket and a cover. The male-threaded end of the bulb casing is screwed with the female threads of an outer sleeve of the casing socket. The bulblet is inserted into the bulblet socket which is inserted into the inner sleeve. A cover has a protruded post and two recess holes. The lower portion of the outer sleeve is covered by the cover.

1 Claim, 5 Drawing Sheets

MOISTUREPROOF DECORATIVE BULB FOR CHRISTMAS DECORATIONS

BACKGROUND OF THIS INVENTION

This invention relates to a decorative bulb, and more particularly to a moistureproof bulb which is suitable for Christmas decorations in the Christmas season.

Referring to FIGS. 1 and 2, a conventional decorative lamp 10 has a glass envelope 11, an envelope socket 12, a bulblet 13, a bulblet socket 14, a base body 15, a base cover 16 and wires 17. The envelope 11 has a flanged end 111. The envelope socket 12 has a groove 121 inside the upper end therein and a plurality of protrusions at the outer periphery of the upper end thereon. The bulblet 13 has a filament 131 therein. The bulblet socket 14 which has through holes 141 to receive the filament 131 receives the bulblet 13. The base body 15 has an inner sleeve 151 and an outer sleeve 152. The inner sleeve 151 receives the bulblet socket 14. The envelope socket 12 is inserted into the base body 15 via the gap between the sleeves 151 and 152. The protrusions 122 are snapped into the inner periphery of the outer sleeve 152. The two ends of the filament 131 connect to the corresponding copper cathode 1511 and anode 1512. Each electrode 1511, 1512 connects to a wire 17. The base cover 16 encloses the lower opening of the outer sleeve 15. However, the conventional decorative lamp 10 has the following disadvantages: (1) The combination of the lamp 10 is cumbersome. (2) The glass envelope 11 is difficult to be drawn away from the envelope socket 12, and the glass envelope 11 is easily broken while it is drawn apart. (3) If the bulblet 11 is worn out, the bulblet 11 is difficult to be changed. (4) The bulblet 11 is in an enclosed interior to be affected by the heat, and then the bulblet 11 is easily damaged. (5) The base body 15 is inserted into the inner sleeve 151. The matching between the base body 15 and the inner sleeve 151 is not fixative, and the loosening bulblet 11 is always extinguished.

SUMMARY OF THIS INVENTION

The main object of this invention is to provide a decorative bulb which can resist water and moist completely.

Another object of this invention is to provide a decorative bulb whose bulb casing easily drawn away and whose bulblet is easily changed.

further object of this invention is to provide a decorative bulb which is easily assembled.

DESCRIPTION OF THE PREFERRED EMBODIMENT

Figure 1:
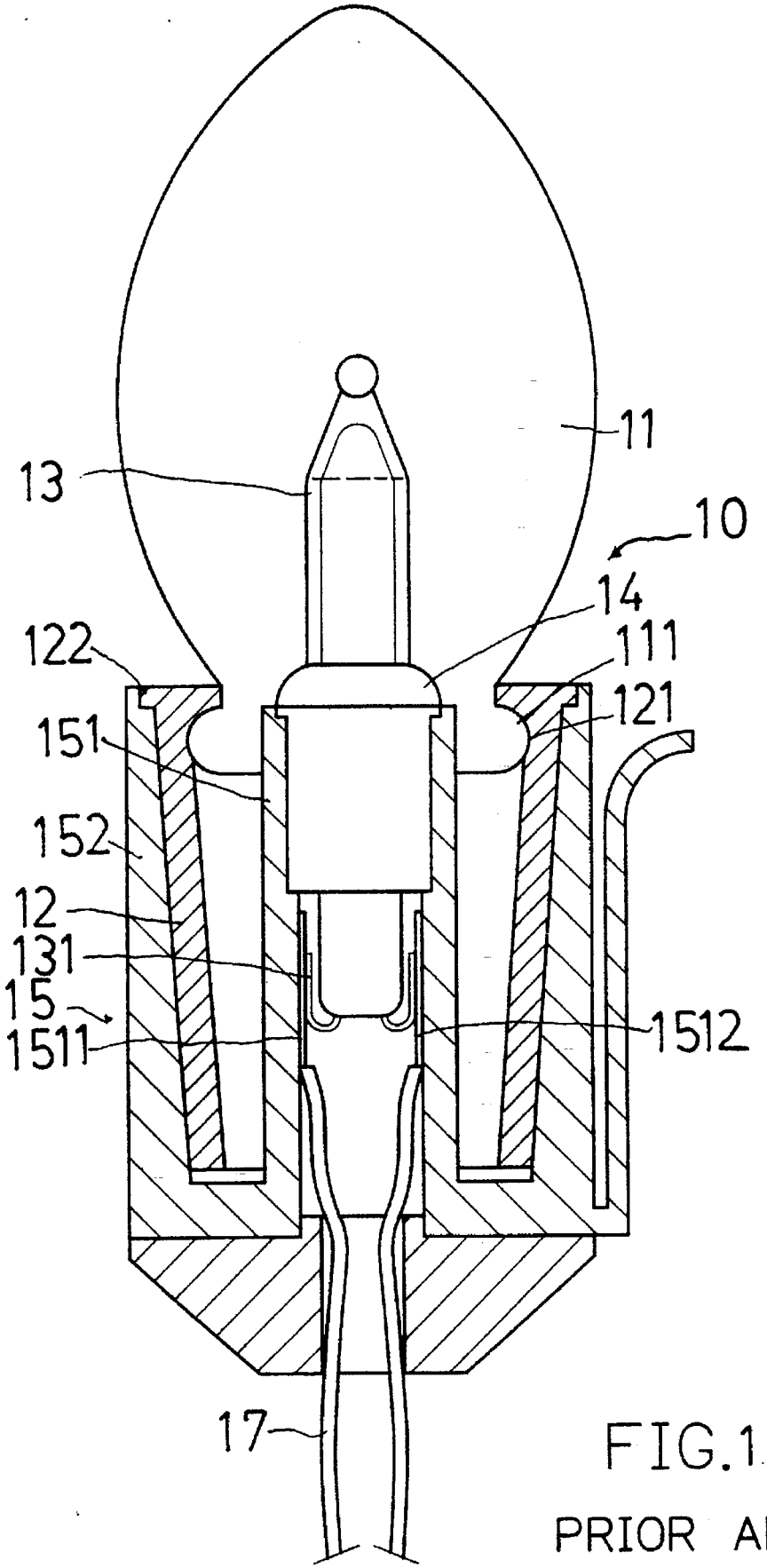
FIG.1 PRIOR ART
FIG. 1 is a sectional view of a conventional decorative lamp of the prior art.
Figure 2:
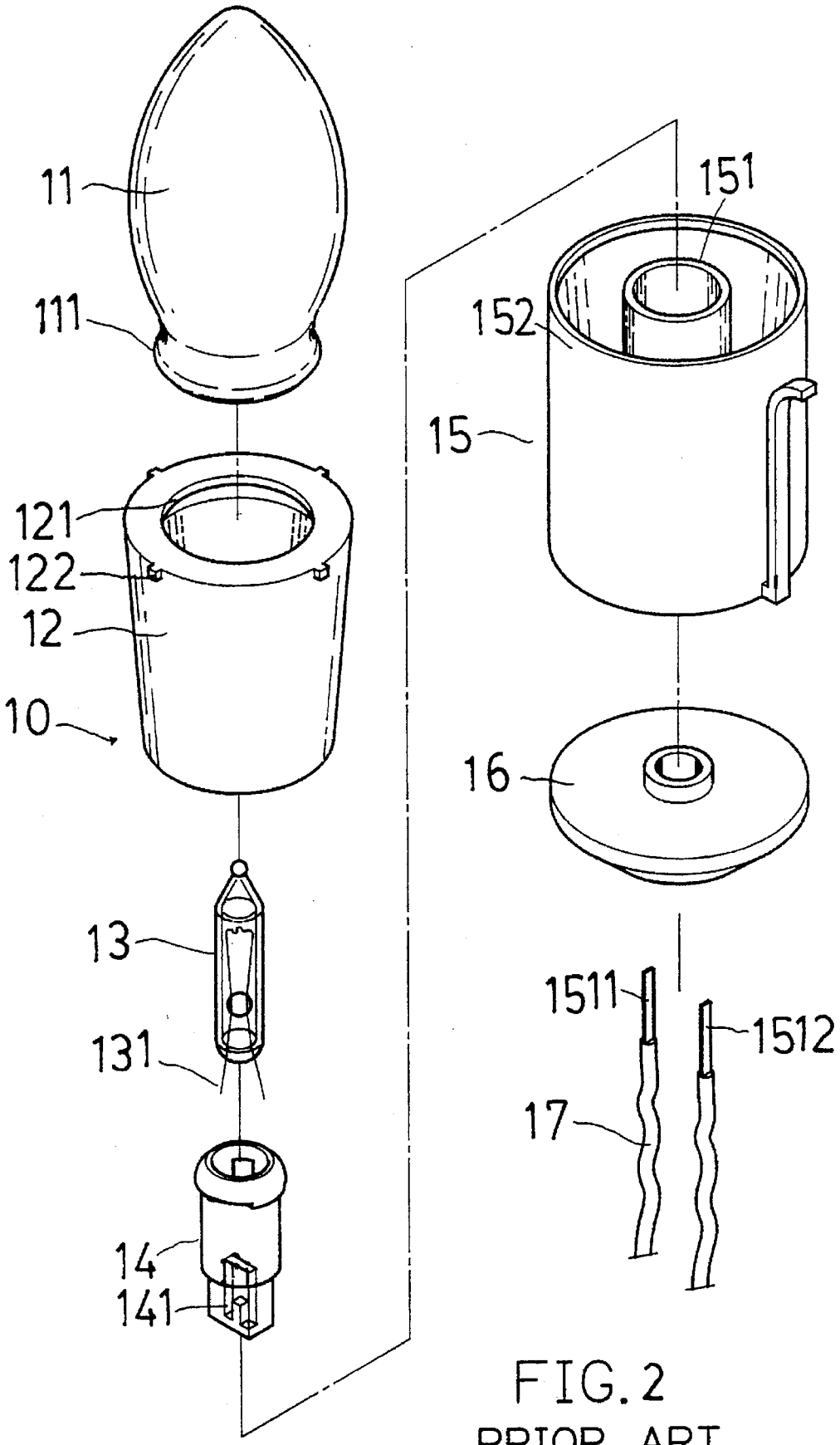
FIG. 2 PRIOR ART
FIG. 2 is a perspective exploded view of FIG. 1.
Figure 3:
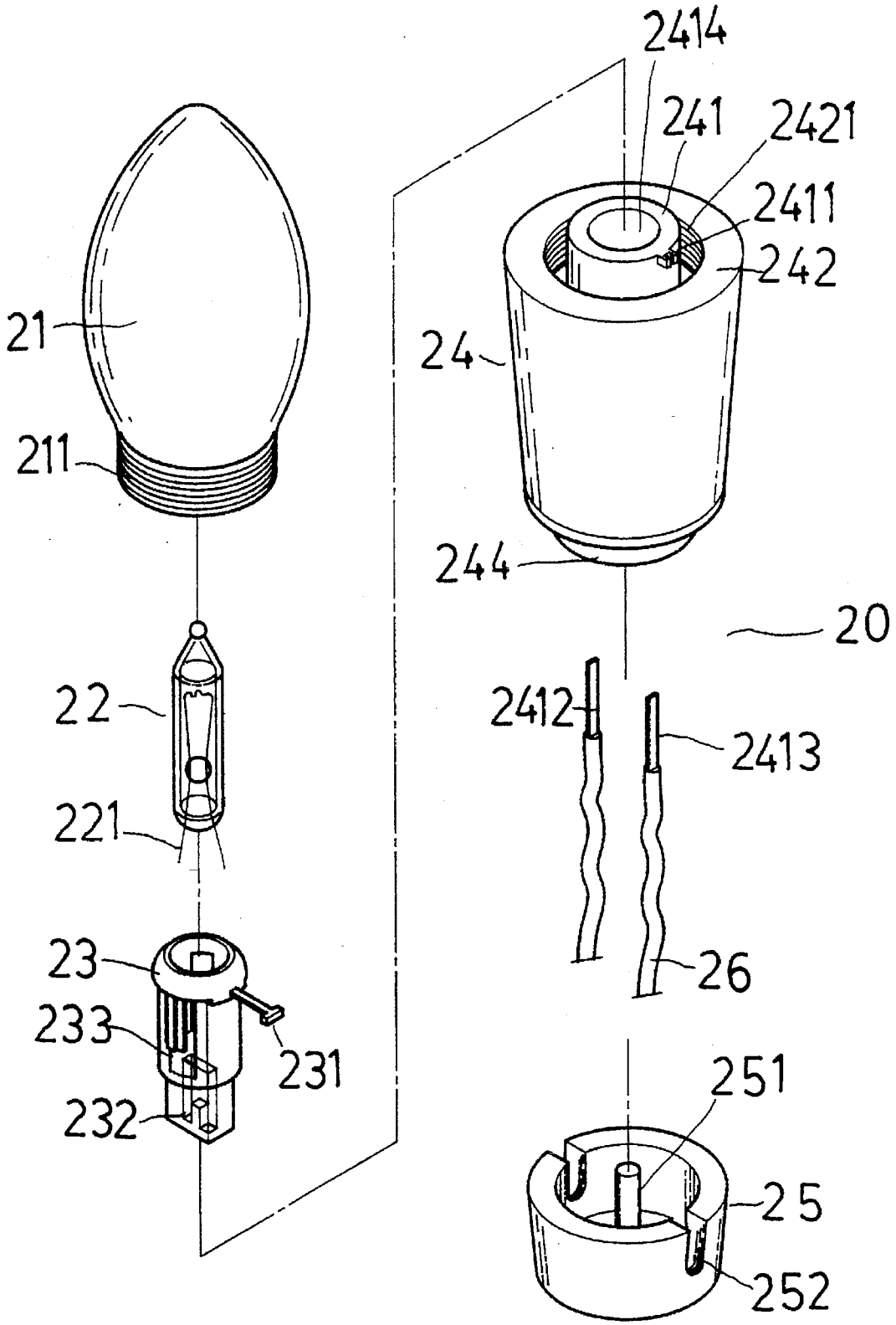
FIG. 3 is a perspective exploded view of a moistureproof decorative bulb for Christmas decorative in accordance with this invention.
Figure 4:
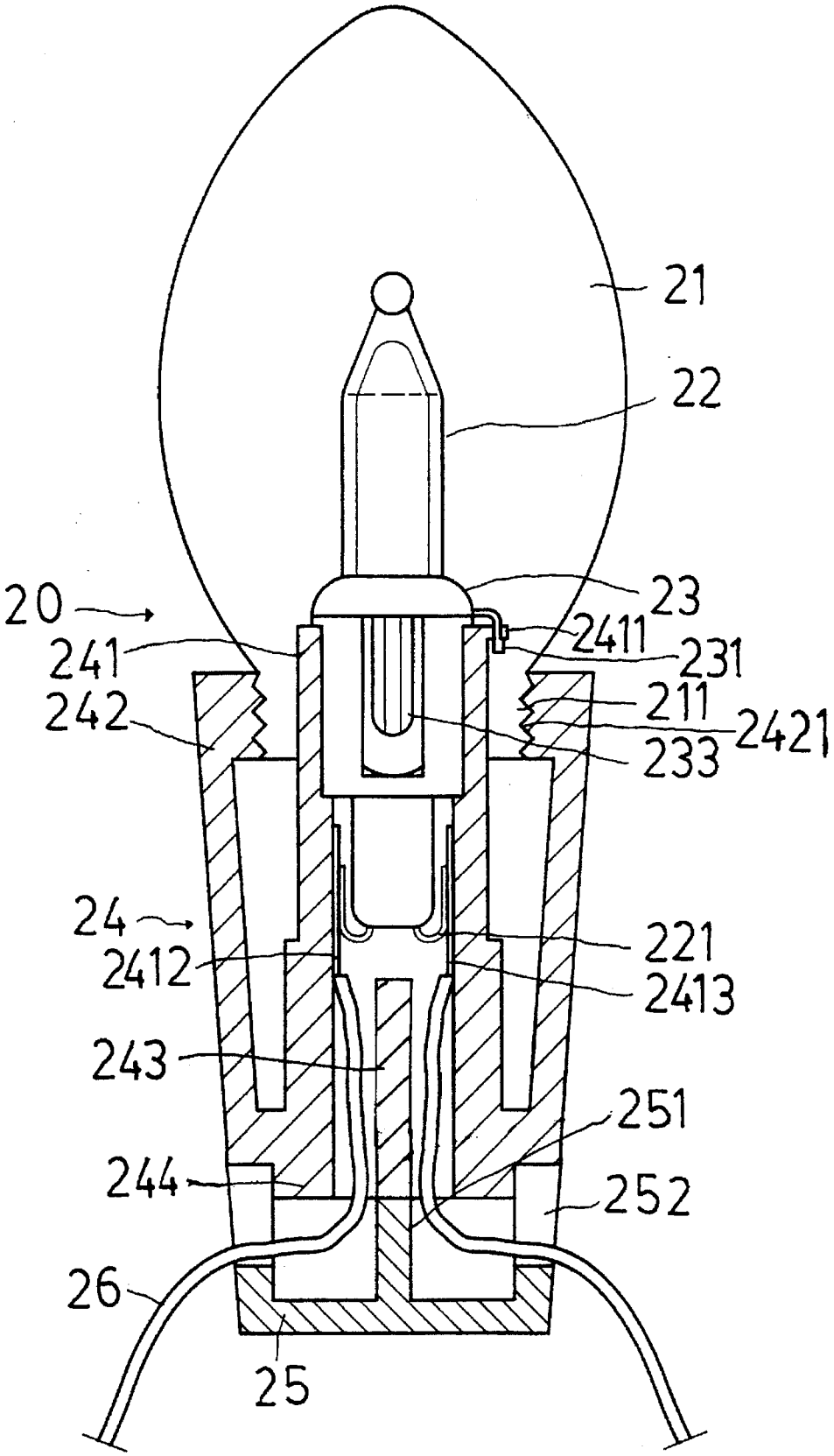
FIG. 4 is a sectional assembly view of FIG. 3.

Referring to FIGS. 3 and 4, a decorative bulb 20 for Christmas trees is illustrated. The decorative bulb 20 contains a bulb casing 21, a bulblet 22, a bulblet socket 23, a casing socket 24, a cover 25 and two wires 26. The bulb casing 21 is made of glass or plastics such as polyethylene, polycarbonate and polyvinyl chloride. The bulb casing 21 is transparent and the color of the bulb casing 21 optional. The end portion of the bulb casing 21 is a mate-threaded end 211. The bulblet 22 has a filament 221 therein. An upper portion of the bulblet 22 is inserted in the bulb casing 21, and a lower portion of the bulblet 22 is inserted into the bulblet socket 23 which has a hollow interior 233 in the middle interior and two through holes 232 in the lower interior. The upper outer periphery of the bulblet socket 23 has a flexible rod 231. The two ends of the filament 221 are bent outside the bulblet socket 23 via the corresponding holes 232. The heat of the bulblet 22 can be dissipated via the hollow interior 233. The casing socket 24 has an inner sleeve 241 with a central hole 2414, an outer sleeve 242 with female threads 2421. The female threads 2421 engage with the male-threaded end 211 to position the male-threaded end 211 between the inner sleeve 241 and the outer sleeve 242. The upper outer periphery of the inner sleeve 241 has a snap fastener 211 to fasten the bend flexible rod 231. The bulblet socket 23 is inserted into the inner sleeve 241. In U.S. Pat. No. 5,443,402, the snap fastener 2411 has been disclosed by this inventor. The two ends of the filament 221 contact the corresponding copper cathode 2412 and anode 2413 via the central hole 2414. Each electrode 2412, 2413 connects to the corresponding wire 26. The height of the inner sleeve 241 is higher than that of the outer sleeve 242 in order to detach the bent flexible rod 231 if necessary. The cover 25 has a central protruded post 251 and two recess holes 252 at its periphery to guide the wires 26. When the cover 25 covers the protruded end 243 of the casing socket 24, the protruded post 251 presses the wires 26 tightly in the central hole 2414 in order to press the wires 26 fixedly.

Figure 5:
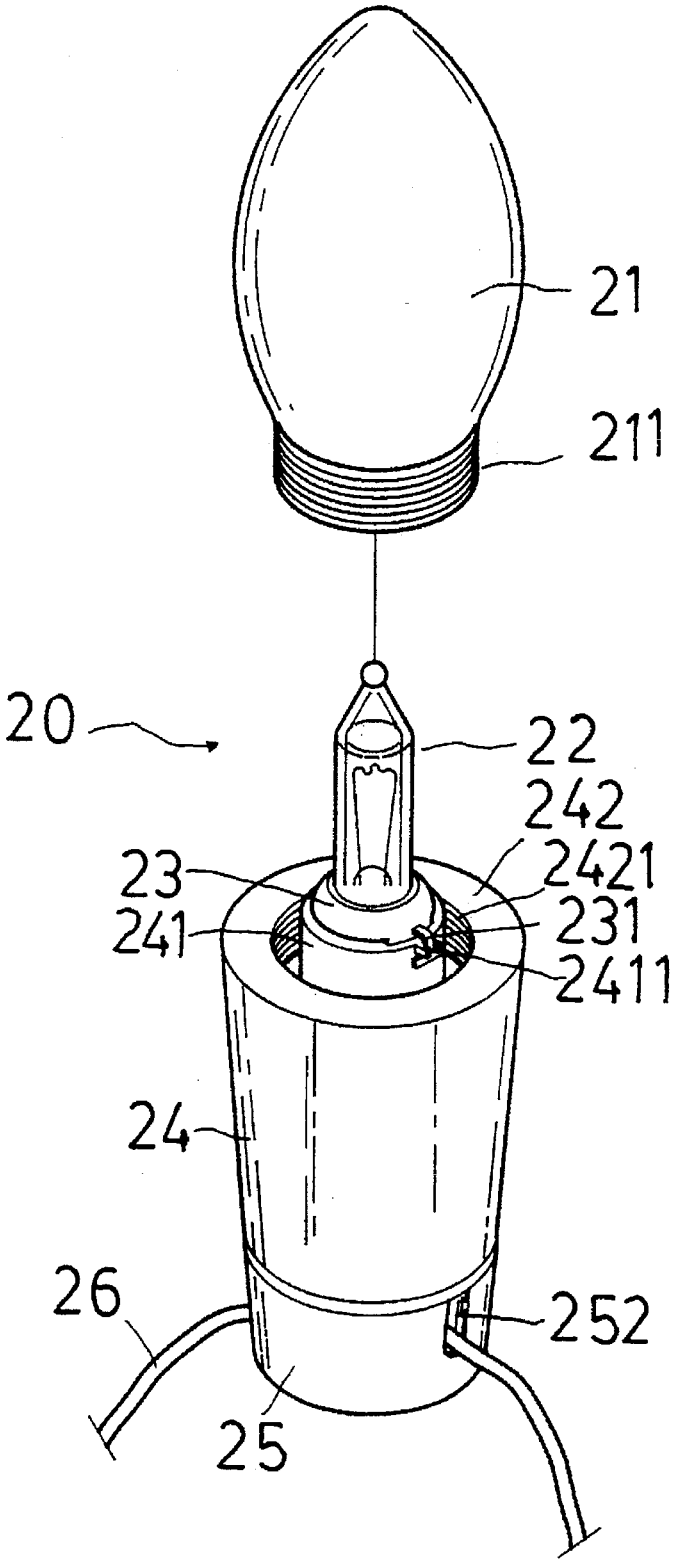
FIG. 5 is a perspective assembly view of FIG. 3.

Referring to FIGS. 4 and 5, the decorative bulb 20 is assembled as follows. The bulblet 22 is inserted into the bulblet socket 23 which is inserted into the inner sleeve 241. The flexible rod 231 is bent and snapped into the snap fastener 2411 so that the bulblet socket 23 is fastened in the inner sleeve 241 fixedly. The inner lower portion of the inner sleeve 241 has a separator 243 therein. The separator 243 divides the inner lower portion of the inner sleeve 241 into two equal partitions in order to separate the cathode 2412 and the anode 2413. The protruded end 244 is pressed into the cover 25 and the wires 26 are drawn out from the inner sleeve 241 to the recess holes 252. The bulb casing 21 is connected to the upper portion of the outer sleeve 241. This invention has the following advantages: (1) The bulb casing 21 is easily removed while the bulblet 22 is damaged. (2) The whole assembly is easily assembled. (3) The casing socket 24 is integratedly formed in single piece to guarantee the moistureproof quality. (4) The bulblet socket 23 will not be loosened from the casing socket 24. (5) The heat of bulblet 22 can be dissipated. (6) The process of manufacture is fast and low-cost.

What is claimed is:

1. A decorative bulb having:

a bulb casing whose lower end is a male-threaded end;

a bulblet with a filament therein;

a hollow bulblet socket having a hollow middle interior and two through holes in a lower interior of said bulblet socket;

a flexible rod disposed on an upper outer periphery of said bulblet socket;

a casing socket having an outer sleeve which has a lower protruded end and upper inner female threads and an inner sleeve which has a snap fastener disposed on an upper outer periphery of said inner sleeve;

a lower end of said inner sleeve connected and disposed in said outer sleeve;

said bulblet socket being inserted into said inner sleeve;

an upper portion of said bulblet being inserted in said bulb casing;

a lower portion of said bulblet being inserted in said bulblet socket;

a central hole formed in a central portion of said inner sleeve;

two ends of said filament being bent outside said bulblet socket via said through holes respectively to contact a corresponding copper cathode and copper anode which are connected to two corresponding wires respectively;

a cover with a central protruded post and two recess holes;

said wires being drawn out from said inner sleeve to said recess holes respectively;

said female threads engaging with said male-threaded end tightly to position said male-threaded end between said inner sleeve and said outer sleeve;

said protruded end of said outer sleeve being inserted into said cover;

said inner sleeve having a separator which is disposed in an inner lower portion of said inner sleeve; and said inner sleeve higher than said outer sleeve at a predetermined height.

* * * * *